US010571100B2

(12) United States Patent
Ding et al.

(10) Patent No.: US 10,571,100 B2
(45) Date of Patent: Feb. 25, 2020

(54) WIRELESS LIGHT EMITTING DIODE LAMP

(71) Applicant: SHENZHEN ZHONGFUNENG ELECTRIC EQUIPMENT CO., LTD., Shenzhen, Guangdong (CN)

(72) Inventors: Baiping Ding, Shenzhen (CN); Baidong Ding, Shenzhen (CN); Yangbiao Huang, Shenzhen (CN)

(73) Assignee: SHENZHEN ZHONGFUNENG ELECTRIC EQUIPMENT CO., LTD, Shenzhen, Guangdong (CN)

( * ) Notice: Subject to any disclaimer, the term of this patent is extended or adjusted under 35 U.S.C. 154(b) by 105 days.

(21) Appl. No.: 15/770,058

(22) PCT Filed: Mar. 18, 2016

(86) PCT No.: PCT/CN2016/076673
§ 371 (c)(1),
(2) Date: Aug. 27, 2018

(87) PCT Pub. No.: WO2017/067131
PCT Pub. Date: Apr. 27, 2017

(65) Prior Publication Data

US 2018/0363890 A1 Dec. 20, 2018

(30) Foreign Application Priority Data

Oct. 22, 2015 (CN) ..... 2015 1 0694891

(51) Int. Cl.
*F21V 21/096* (2006.01)
*F21V 17/06* (2006.01)
(Continued)

(52) U.S. Cl.
CPC ..... *F21V 21/096* (2013.01); *F21V 17/06* (2013.01); *F21V 17/16* (2013.01);
(Continued)

(58) Field of Classification Search
CPC ..... F21V 21/096; F21V 21/0816; F21V 21/0965; F21V 21/08; F21V 21/0832;
(Continued)

(56) References Cited

FOREIGN PATENT DOCUMENTS

CN 202049831 U 11/2011
CN 202675191 U 1/2013
(Continued)

OTHER PUBLICATIONS

International Search Report, Application No. PCT/CN2016/076673, dated Jul. 21, 2016, 4 pages.

*Primary Examiner* — Joseph L Williams
*Assistant Examiner* — Jose M Diaz
(74) *Attorney, Agent, or Firm* — Ziegler IP Law Group, LLC

(57) ABSTRACT

A magnetically attachable wireless light emitting diode lamp includes a light emitting diode lamp assembly, a magnetic part (2) and a holding part (1). The light emitting diode lamp assembly is provided with buckles (4). The holding part is provided with buckling holes (3). The buckle (4) and the buckling hole (3) are matched and connected. The holding part (1) is provided with a recess structure at the center. The magnetic part (2) is matched with and mounted in the recess structure of the holding part (1). The magnetically attachable wireless light emitting diode lamp is simple in structure and convenient to install, and can be used under severe conditions. When a strong magnet is used, the magnetic force can reach 5 kgf or more. The magnetically attachable wireless light emitting diode lamp is both convenient and firm.

16 Claims, 3 Drawing Sheets

(51) Int. Cl.

| | |
|---|---|
| ***F21V 17/16*** | (2006.01) |
| ***F21Y 115/10*** | (2016.01) |
| ***H01F 1/057*** | (2006.01) |
| ***F21V 21/08*** | (2006.01) |
| ***H01F 7/02*** | (2006.01) |

(52) U.S. Cl.
CPC ..... *F21V 21/0816* (2013.01); *H01F 7/0221* (2013.01); *H01F 7/0252* (2013.01); *F21Y 2115/10* (2016.08); *H01F 1/057* (2013.01)

(58) Field of Classification Search
CPC ..... F21V 21/088; F21V 17/06; F21V 17/16; H01F 1/057; F21Y 2115/10
See application file for complete search history.

(56) References Cited

FOREIGN PATENT DOCUMENTS

| | | | |
|---|---|---|---|
| CN | 104613402 | A | 5/2015 |
| CN | 204593173 | U | 8/2015 |
| CN | 104924834 | A | 9/2015 |
| CN | 104948927 | A | 9/2015 |
| CN | 104949036 | A | 9/2015 |
| CN | 204667813 | U | 9/2015 |
| CN | 204678078 | U | 9/2015 |

WIRELESS LIGHT EMITTING DIODE LAMP

TECHNICAL FIELD

The present disclosure relates to the field of wireless light emitting diode lamps, and in particular to a magnetically attachable wireless light emitting diode lamp.

BACKGROUND

The wireless light emitting diode lamp provides a temporary illumination function and can be used outdoors or indoors. The existing wireless light emitting diode lamp includes a rechargeable battery. The rechargeable battery is charged by an external power supply, and the rechargeable battery supplies power to the light emitting diode lamp to achieve the purpose of illumination. As the wireless light emitting diode lamp includes the rechargeable battery, a shell, and other components, the wireless light emitting diode lamp has a certain weight. In the existing arts, most wireless light emitting diode lamps are fixed by clips and cap hooks and other devices. For example, Chinese patent CN202675191U discloses a cap hook device for a mining lamp. The cap hook device includes a main body and a hook. The two upper sides of the main body have two bosses, which protruded and perpendicular to the main body and are in the opposite direction of the hook. Ends of the two bosses, away from the main body, are each provided with a fixing boss perpendicular to the two bosses. The two fixing bosses are each provided with a through-hole. The hook is a duck tongue structure with a middle being a hanging nail device in a hollow structure. The main body of the cap hook is also a hollow structure and made from stainless steel material. The upper part of the main body of the cap hook has two L-shaped continuous bosses. Therefore, for a case where the mounting and fixing position of the cap hook device is recessed on the rear cover surface of the mining lamp, the cap hook device can be directly mounted on the mining lamp without any additional connection structure and the device. The installing of the cap hook device will be more convenient. Since the cap hook device is made from the stainless steel material, the cap hook device can be used in severe conditions. However, the existing art has disadvantages such as a complicated structure.

SUMMARY

A magnetically attachable wireless light emitting diode lamp includes a light emitting diode lamp assembly, a magnetic part and a holding part. The light emitting diode lamp assembly is provided with buckles. The holding part is provided with buckling holes. The buckle and the buckling hole are matched and connected. The holding part is provided with a recess structure at the center. The magnetic part is matched with and mounted in the recess structure of the holding part.

In the existing arts, the wireless light emitting diode lamp is often fixed by means of a cap hook device and the like, which is inconvenient to use. The present disclosure provides a magnetically attachable wireless light emitting diode lamp which is convenient to use and can be used under very severe conditions. Especially when a strong magnet is used, the magnetic force can reach more than 5 kgf, which is both convenient and firm.

Preferably, the strong magnet includes a neodymium-iron-boron magnet, a ferrite magnet, an aluminum-nickel-cobalt magnet, and a samarium cobalt magnet. More preferably, the magnetic part is a neodymium-iron-boron magnet, the magnetic performance of which greatly exceeds the magnetic properties of ferrite magnets, aluminum-nickel-cobalt, samarium-cobalt and other magnets, and the neodymium-iron-boron magnet can attract objects with 640 times weight of itself.

Preferably, the buckle is a movable elastic buckle, which is convenient for the buckle to be installed on the buckling hole.

Preferably, the buckling holes are provided on opposite sides of the holding part respectively. Each of the opposite sides is provided with a buckling hole. The connection between the buckling hole and the buckle can be more firm, and the buckle is not easy to fall off from the buckling hole.

More preferably, one surface of the holding part is a square, and the buckling holes are provided on four sides of the holding part. Compared with the buckling hole on the opposite sides, the buckling hole installed on the four sides can make the installation of the holding part better. When one surface of the holding part is square, it is not necessary to select the direction of the opposite sides during installation, and the holding part can be installed easily, which is more convenient.

Preferably, one surface of the magnetic part is a square, and the recessed structure of the holding part is a square too.

Preferably, one surface of the magnetic part is circular, and the recessed structure of the holding part is circular too. When the magnetic part is circular, the installation efficiency of the magnetic part and the holding part can be improved. In addition, comparing with the square, the area of the circle is larger and the magnetic effect can be improved.

Preferably, the magnetic part is adhered to the recessed structure of the holding part by UV adhesive. The UV adhesive is also called photosensitive adhesive, ultraviolet curing adhesive, which refers to a type of adhesive that is cured only by ultraviolet light irradiation, and the UV adhesive can be used as a binder.

The present disclosure has the following beneficial effects. The present disclosure provides a magnetically attachable wireless light emitting diode lamp is simple in structure and convenient to install, convenient to use, and can be used under severe conditions. Especially when a strong magnet is used, the magnetic force can reach 5 kgf or more, which is both convenient and firm.

BRIEF DESCRIPTION OF DRAWINGS

In order to more clearly explain the technical solutions of the embodiments of the present disclosure, the drawings used in the description of the embodiments are briefly described below. Obviously, the drawings described below are merely some embodiments of the present disclosure. Those skilled in the art can also obtain other drawings based on these drawings without any creative work.

In the drawings.

1: holding part, 2: magnetic part, 3: buckling hole provided on the holding part, 4: buckle provided on the light emitting diode lamp assembly of the magnetically attachable wireless light emitting diode lamp.

DETAILED DESCRIPTION

In order to make those skilled in the art better understand the solution of the present disclosure, the technical solutions in the embodiments of the present invention will be clearly described below in conjunction with the drawings in the embodiments of the present disclosure. Obviously, the described embodiments are merely some embodiments, but not all embodiments of the present disclosure. All other embodiments obtained by those skilled in the art based on the embodiments of the present disclosure without creative efforts shall fall within the protection scope of the present disclosure.

Embodiment I

Figure 1:
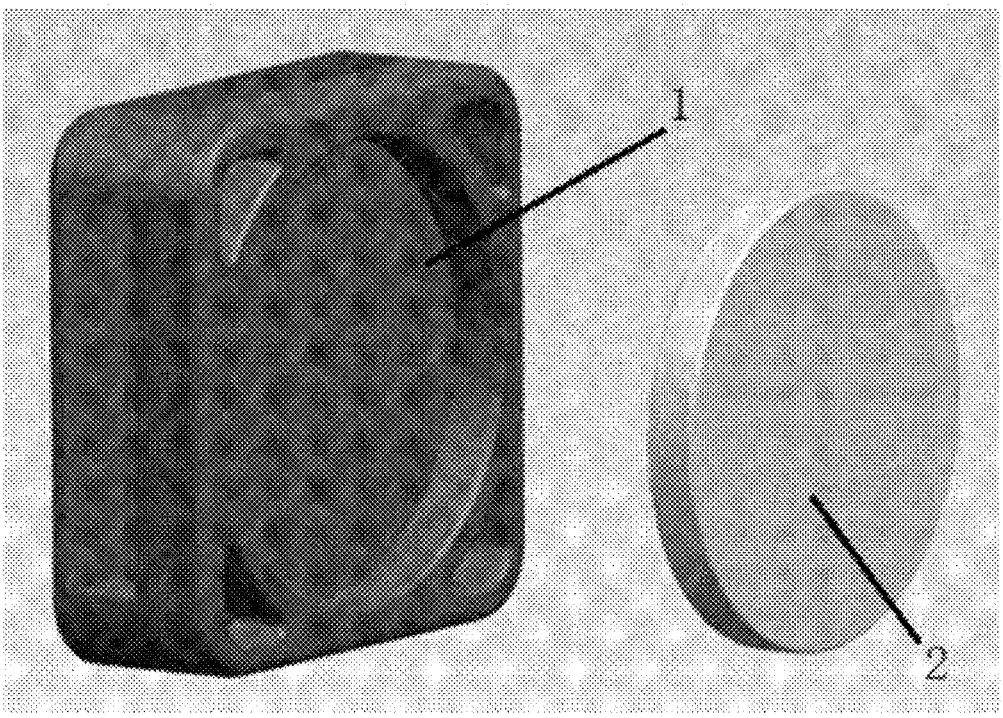
FIG. 1 is a schematic structure diagram of a magnetic sticky according to the present disclosure.
Figure 2:
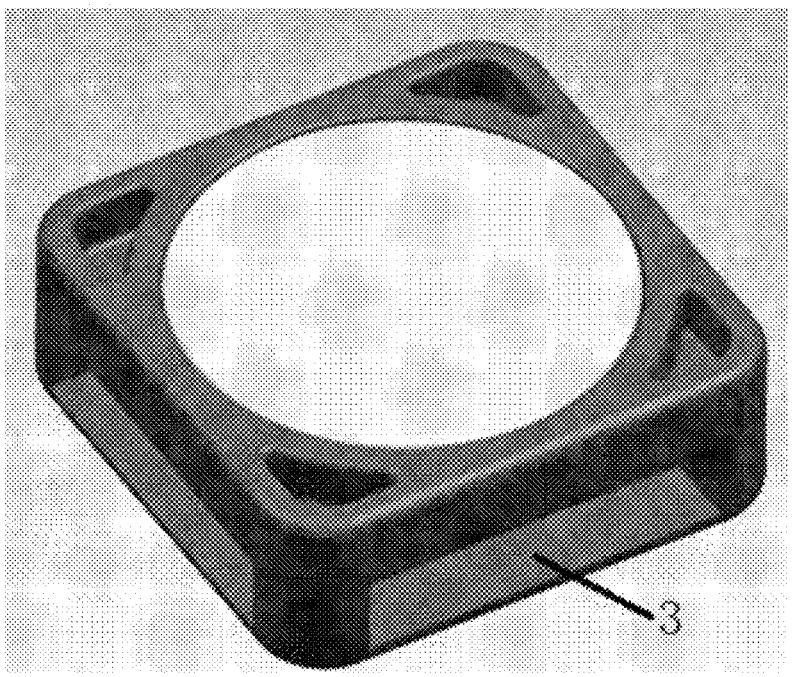
FIG. 2 is an assembly structure diagram of a magnetic sticky according to the present disclosure.
Figure 3:
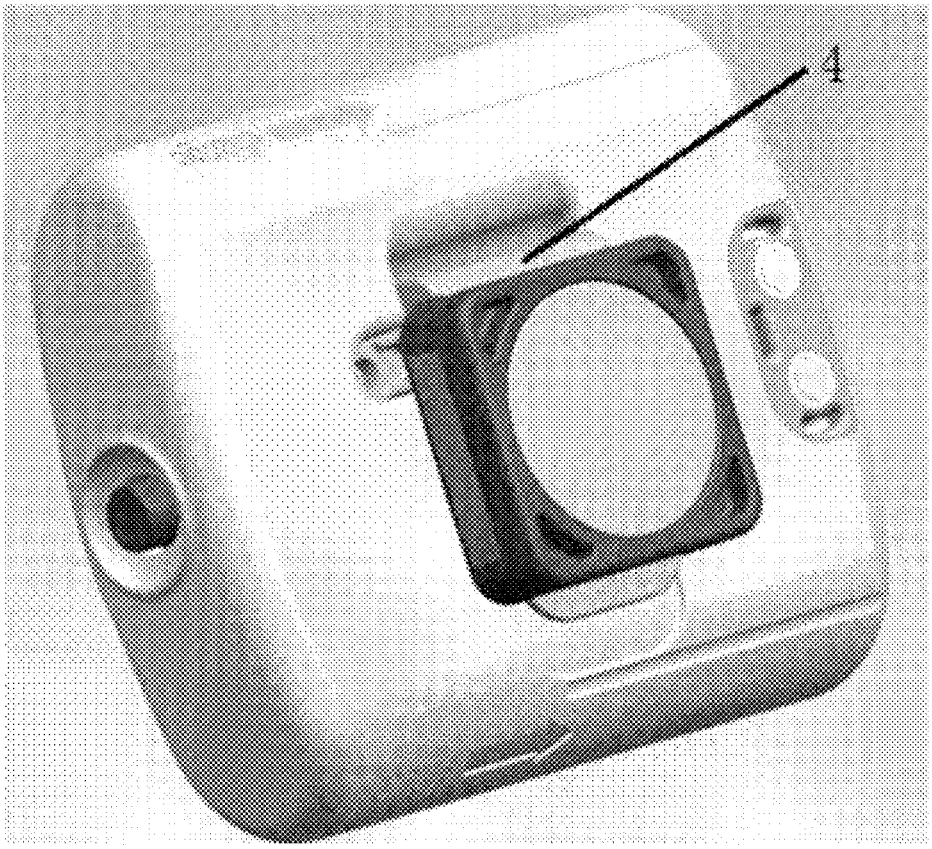
FIG. 3 is an overall structure diagram of a magnetically attachable wireless light emitting diode lamp according to the present disclosure.

As shown in FIG. 1 to FIG. 3, a magnetically attachable wireless light emitting diode lamp includes a light emitting diode lamp assembly, a magnetic part and a holding part. The light emitting diode lamp assembly is provided with a buckle. The holding part is provided with a buckling hole. The buckle and the buckling hole are matched and connected. The holding part is provided with a recess structure at the center. The magnetic part is matched with and mounted in the recess structure of the holding part. One surface of the magnetic part is circular, one surface of the holding part is a square, and the recessed structure is circular too. The magnetic part and the recessed structure of the holding part are adhered by UV adhesive. In addition, the light emitting diode lamp assembly is provided with buckles, and four sides of the holding part are provided with buckling holes, and the buckle is matched with the buckling hole.

Embodiment II

As shown in FIG. 1 to FIG. 3, a magnetically attachable wireless light emitting diode lamp includes a light emitting diode lamp assembly, a magnetic part and a holding part. The light emitting diode lamp assembly is provided with a buckle. The holding part is provided with a buckling hole. The buckle and the buckling hole are matched and connected. The holding part is provided with a recess structure at the center. The magnetic part is matched with and mounted in the recess structure of the holding part. One surface of the magnetic part is circular, one surface of the holding part is a square, and the recessed structure is circular too. The magnetic part and the recessed structure of the holding part are adhered by UV adhesive. In addition, the light emitting diode lamp assembly is provided with buckles, and the opposite sides of the holding part are provided with buckling holes, and the buckle is matched with the buckling hole.

Embodiment III

A magnetically attachable wireless light emitting diode lamp includes a light emitting diode lamp assembly, a magnetic part and a holding part. The light emitting diode lamp assembly is provided with a buckle. The holding part is provided with a buckling hole. The buckle and the buckling hole are matched and connected. The holding part is provided with a recess structure at the center. The magnetic part is matched with and mounted in the recess structure of the holding part. One surface of the magnetic part is a square, one surface of the holding part is a square, and the recessed structure is a square too. The magnetic part and the recessed structure of the holding part are adhered by UV adhesive. In addition, the light emitting diode lamp assembly is provided with buckles, and four sides of the holding part are provided with buckling holes, and the buckle is matched with the buckling hole.

Embodiment IV

A magnetically attachable wireless light emitting diode lamp includes a light emitting diode lamp assembly, a magnetic part and a holding part. The light emitting diode lamp assembly is provided with a buckle. The holding part is provided with a buckling hole. The buckle and the buckling hole are matched and connected. The holding part is provided with a recess structure at the center. The magnetic part is matched with and mounted in the recess structure of the holding part. One surface of the magnetic part is a square, one surface of the holding part is a square, and the recessed structure is a square too. The magnetic part and the recessed structure of the holding part are adhered by UV adhesive. In addition, the light emitting diode lamp assembly is provided with buckles, and the opposite sides of the holding part are provided with buckling holes, and the buckle is matched with the buckling hole.

The foregoing embodiments are merely preferred embodiments of the present disclosure, and the protection scope of the present invention is not limited thereto. Any insubstantial changes and replacements, made by those skilled in the art based on the present disclosure, belong to the scope of the present disclosure.

What is claimed is:

1. A wireless light emitting diode lamp, comprising: a light emitting diode lamp assembly, a magnetic part and a holding part;

wherein the light emitting diode lamp assembly is provided with buckles, the holding part is provided with buckling holes; the buckle and the buckling hole are matched and connected, a center of the holding part is provided with a recess structure, and the magnetic part is matched with and mounted in the recess structure of the holding part.

2. The wireless light emitting diode lamp to claim 1, wherein the magnetic part is a strong magnet.

3. The wireless light emitting diode lamp according to claim 2, wherein the strong magnet is selected from a neodymium-iron-boron magnet, a ferrite magnet, an aluminum-nickel-cobalt magnet, or a samarium cobalt magnet.

4. The wireless light emitting diode lamp according to claim 3, wherein the strong magnet is preferably a neodymium-iron-boron magnet.

5. The wireless light emitting diode lamp according to claim 1, wherein the buckle is a movable elastic buckle.

6. The wireless light emitting diode lamp according to claim 1, wherein the buckling holes are disposed on opposite sides of the holding part respectively.

7. The wireless light emitting diode lamp according to claim 1, wherein one surface of the holding part is a square, and the buckling holes are provided on four sides of the holding part.

8. The wireless light emitting diode lamp according to claim 1, wherein one surface of the magnetic part is a square, and the recessed structure of the holding part is a square too.

9. The wireless light emitting diode lamp according to claim 1, wherein one surface of the magnetic part is circular, and the recessed structure of the holding part is circular too.

10. The wireless light emitting diode lamp according to claim 8, wherein the magnetic part is adhered to the recessed structure of the holding part by UV adhesive.

11. The wireless light emitting diode lamp according to claim 2, wherein the buckle is a movable elastic buckle.

12. The wireless light emitting diode lamp according to claim 2, wherein the buckling holes are disposed on opposite sides of the holding part respectively.

13. The wireless light emitting diode lamp according to claim 2, wherein one surface of the holding part is a square, and the buckling holes are provided on four sides of the holding part.

14. The wireless light emitting diode lamp according to claim 2, wherein one surface of the magnetic part is a square, and the recessed structure of the holding part is a square too.

15. The wireless light emitting diode lamp according to claim 2, wherein one surface of the magnetic part is circular, and the recessed structure of the holding part is circular too.

16. The wireless light emitting diode lamp according to claim 9, wherein the magnetic part is adhered to the recessed structure of the holding part by UV adhesive.

* * * * *